US010335932B2

(12) United States Patent
Wang

(10) Patent No.: US 10,335,932 B2
(45) Date of Patent: Jul. 2, 2019

(54) BRAKING STRUCTURE OF RATCHET WRENCH

(71) Applicant: Yeo-Ming Wang, Taipei (TW)

(72) Inventor: Yeo-Ming Wang, Taipei (TW)

( * ) Notice: Subject to any disclaimer, the term of this patent is extended or adjusted under 35 U.S.C. 154(b) by 277 days.

(21) Appl. No.: 14/738,285

(22) Filed: Jun. 12, 2015

(65) Prior Publication Data

US 2016/0361801 A1 Dec. 15, 2016

(51) Int. Cl.

*B25B 23/00* (2006.01)
*B25B 13/46* (2006.01)
*B25G 1/06* (2006.01)

(52) U.S. Cl.

CPC ..... *B25B 23/0028* (2013.01); *B25B 13/461* (2013.01); *B25G 1/063* (2013.01)

(58) Field of Classification Search

CPC ... B25B 23/0028; B25B 13/461; B25G 1/063; B25G 3/38

See application file for complete search history.

(56) References Cited

U.S. PATENT DOCUMENTS 948,946 A * 2/1910 Wittman ..... B25G 1/063 254/DIG. 3
973,779 A * 10/1910 Hansen ..... B25G 1/063 81/165
6,848,345 B2 * 2/2005 Lin ..... B25G 1/063 403/91
7,131,356 B2 * 11/2006 Lin ..... B25B 13/461 81/177.9
2008/0006125 A1 * 1/2008 Chen ..... B25B 13/463 81/63.1
2010/0294090 A1 * 11/2010 Tsai ..... B25G 1/063 81/177.9
2011/0167967 A1 * 7/2011 Chen ..... B25G 1/063 81/177.8
2012/0247280 A1 * 10/2012 Cheng ..... B25B 13/461 81/177.8
2013/0269491 A1 * 10/2013 Chang ..... B25B 23/16 81/177.8

(Continued)

FOREIGN PATENT DOCUMENTS

TW M265163 U 5/2005

*Primary Examiner* — Joseph J Hail
*Assistant Examiner* — J Stephen Taylor
(74) *Attorney, Agent, or Firm* — Muncy, Geissler, Olds & Lowe, P.C.

(57) ABSTRACT

A braking structure of a ratchet wrench comprises: a wrench head, having an operating portion, a rear end thereof being a head pivoting portion, a peripheral of the head pivoting portion having plural urging grooves; a wrench handle, a front end thereof having a handle pivoting portion pivotally connected with the head pivoting portion, the handle pivoting portion having a pivoting room, an acting through hole at a rear end of the pivoting room and extending toward the wrench handle, a positioning device being neighbor to a rear end of the handle pivoting portion and having a slim acting slot, a hole being in the acting slot and being perpendicular to an extension direction of the wrench handle; an urging device, having an urging rod; an operation device, having a pushing member that has an inserting rod, the inserting rod having a positioning through hole vertical to the inserting rod.

5 Claims, 9 Drawing Sheets

(56) References Cited

U.S. PATENT DOCUMENTS

2014/0047955 A1* 2/2014 Ou ..... B25B 13/463
81/60
2014/0202290 A1* 7/2014 Hsieh ..... B25G 1/063
81/177.8

* cited by examiner

BRAKING STRUCTURE OF RATCHET WRENCH

BACKGROUND OF THE INVENTION

1. Field of the Invention

The present invention generally relates to a wrench structure, more particularly to a braking structure of a ratchet wrench that facilitates assembly, operation and may not easily malfunction.

2. Description of the Prior Art

Wrenches are commonly used for operation in order to facilitate tighten, loosen a screw or nut and other kinds of positioning workpiece, and includes many different types, such as open-end wrench, combination wrench, box wrench, adjustable wrench, socket wrench, and so on. A general structure of a wrench normally comprises a head and a handle. The head has an accommodation room to accommodate screws or nuts. Via the accommodation room fitting with screws/nuts, the handle applies rotational forces to tight and loosen screws/nuts. According to positions and angles of workpieces and other operation environments, several sorts of ratchet wrenches with adjusting the angles of lifting and bending head thereof are developed to facilitate operations. A patent, No. M265163 of Republic of China, is related to ratchet wrench. It provides a hand tool with a joint locking mechanism and has a head 20, a handle 30, a joint locking mechanism 40, and a pull knob device 45. The head 20 has a rear end. The handle 30 has a front end connected with the rear end of the head 20. The joint locking mechanism 40 is disposed between the front end of the handle 30 and the rear end of the head 20. The front end of the handle 30 has a first hole 33 approximately elongating along the length direction of the handle 30 and a second hole 34 perpendicularly connected with the first hole 33. The joint locking mechanism 40 has a plurality of grooves 23 at the rear end of the head 20, a lockpin 42 and a first spring 41, wherein the lockpin 42 and the first spring 41 are disposed in the first hole 33 of the front end of the handle 30. The pull knob device 45 has a pull knob portion 451 and a latch hook 452 beneath the pull knob portion 451, wherein the latch hook 452 elongates from the second hole 34 and hooks a latch slot 44 of the lockpin 42. So that the pull knob device 45 drives the lockpin 42 to move in the first hole 33, and the first spring 41 provides elastic forces to drive the lockpin 42 going through a second spring 52 and a positioning board 51 for urging one of the grooves 23.

As aforesaid, a bending angle of the head 20 is adjustable by way of moving the pull knob portion 451, but there are still shortcomings existed. For example, the pull knob device 45 latches the latch slot 44 of the lockpin 42 by means of the latch hook 452 so as to move the lockpin 42. Basically, it makes that the structures of the pull knob device 45 and the lockpin 42 are complicate, and therefore it is not convenient for manufacturing and assembly. Further, the latch hook 452 may be easier to be damaged with time goes by, and it causes malfunctions to the lockpin 42. More, the latch hook 452 latches the latch slot 44 of the lockpin 42, and the latch hook 452 will be worn to happen conditions of loosen, shaking, etc. of the latch hook 452 linking up with the lockpin 42. Hence, how to solve the shortcomings from prior arts becomes an important issue to the people skilled in the art.

Accordingly, the inventor has studied an issue in order to develop a braking structure of a ratchet wrench that facilitates assembly, operation and may not easily malfunction for serving people and advancing life quality.

SUMMARY OF THE INVENTION

The main objective of the present invention is to provide a braking structure of a ratchet wrench, it is composed of an easy linking mechanism in order to convenient for manufacturing and assembly, and it is worth for considering economic benefits.

The second objective of the present invention is to provide a braking structure of a ratchet wrench, and it prevents loosen parts, shaking and even rupture while in operation, and increases stability and operation certainty for enhancing life and operation quality.

To approach above objective, the present invention comprises: a wrench head, having an operating portion, a rear end of the wrench head being a head pivoting portion, a peripheral of the head pivoting portion having a plurality of urging grooves; a wrench handle, a front end of the wrench handle having a handle pivoting portion that is pivotally connected with the head pivoting portion, the handle pivoting portion having a pivoting room, an acting through hole being at a rear end of the pivoting room and extending toward the wrench handle, a positioning device being neighbor to a rear end of the handle pivoting portion and having an acting slot with a slim shape, a hole being in the acting slot and being perpendicular to an extension direction of the wrench handle, wherein the hole is a long hole and is perpendicular to and connected with the acting through hole; an urging device, having an urging rod; an operation device, having a pushing member that has an inserting rod, the inserting rod having a positioning through hole that is vertical to the inserting rod, wherein the diameter of the inserting rod is less than the length of the hole and the positioning through hole corresponds to the acting through hole; wherein the pushing member is disposed in the acting slot, the inserting rod is inserted into the hole, and the urging rod is through the acting through hole, continuously the urging rod is inserted into the positioning through hole for tight connection, and the urging rod is against to one of the urging grooves.

Accordingly, an urging hole is in front of the hole, a spring is in the urging hole, an urging ball is on a top of the spring, a front end of the pushing member has a first urging slot and a second urging slot after the first urging slot.

Accordingly, the diameter of the urging rod is less than the diameter of the acting through hole, a front end of the urging rod is an urging head that has a rotating slot.

Accordingly, a rear end of the urging rod is an urging ladder, the positioning through hole is stuck by the urging ladder.

Accordingly, the urging ladder is a thread.

Accordingly, a top cover is on a top end of the pushing member, and the length of the top cover is longer than the length of the pushing member.

Accordingly, a front edge of the thread is formed as the urging ladder for urging and positioning.

Accordingly, the urging rod is connected with the positioning through hole.

Accordingly, the positioning device has a spring slot at a rear end of the hole, the spring slot is through to the hole and corresponds to the positioning through hole, a flexible member is disposed in the spring slot and urges to a rear end of the urging rod.

BRIEF DESCRIPTION OF THE DRAWINGS

The objects, spirits, and advantages of the preferred embodiments of the present invention will be readily understood by the accompanying drawings and detailed descriptions, wherein.

DETAILED DESCRIPTION OF THE INVENTION

Following preferred embodiments and figures will be described in detail so as to achieve aforesaid objects.

Figure 1:
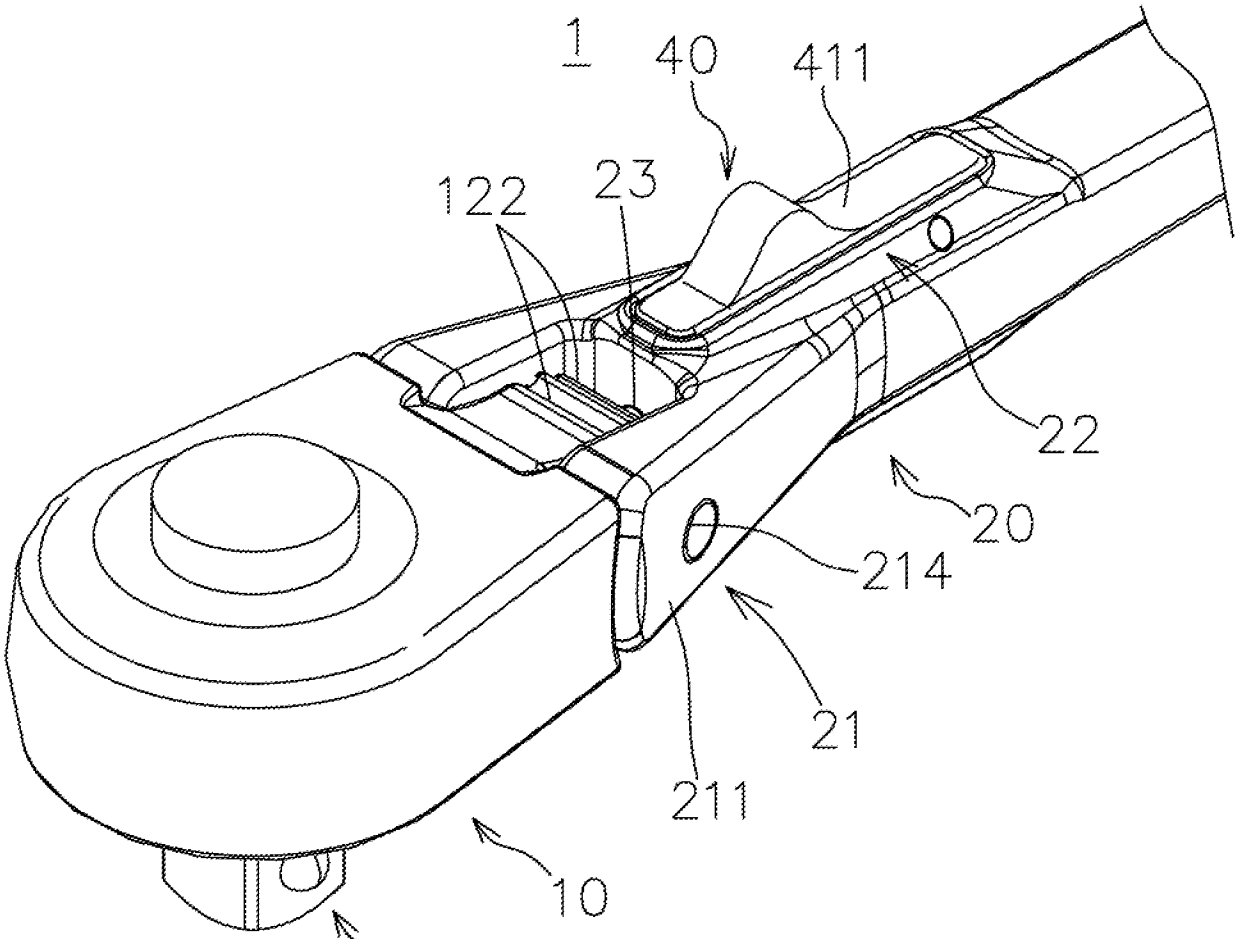
FIG. 1 illustrates a schematic perspective view of a first preferred embodiment of the present invention.
Figure 2:
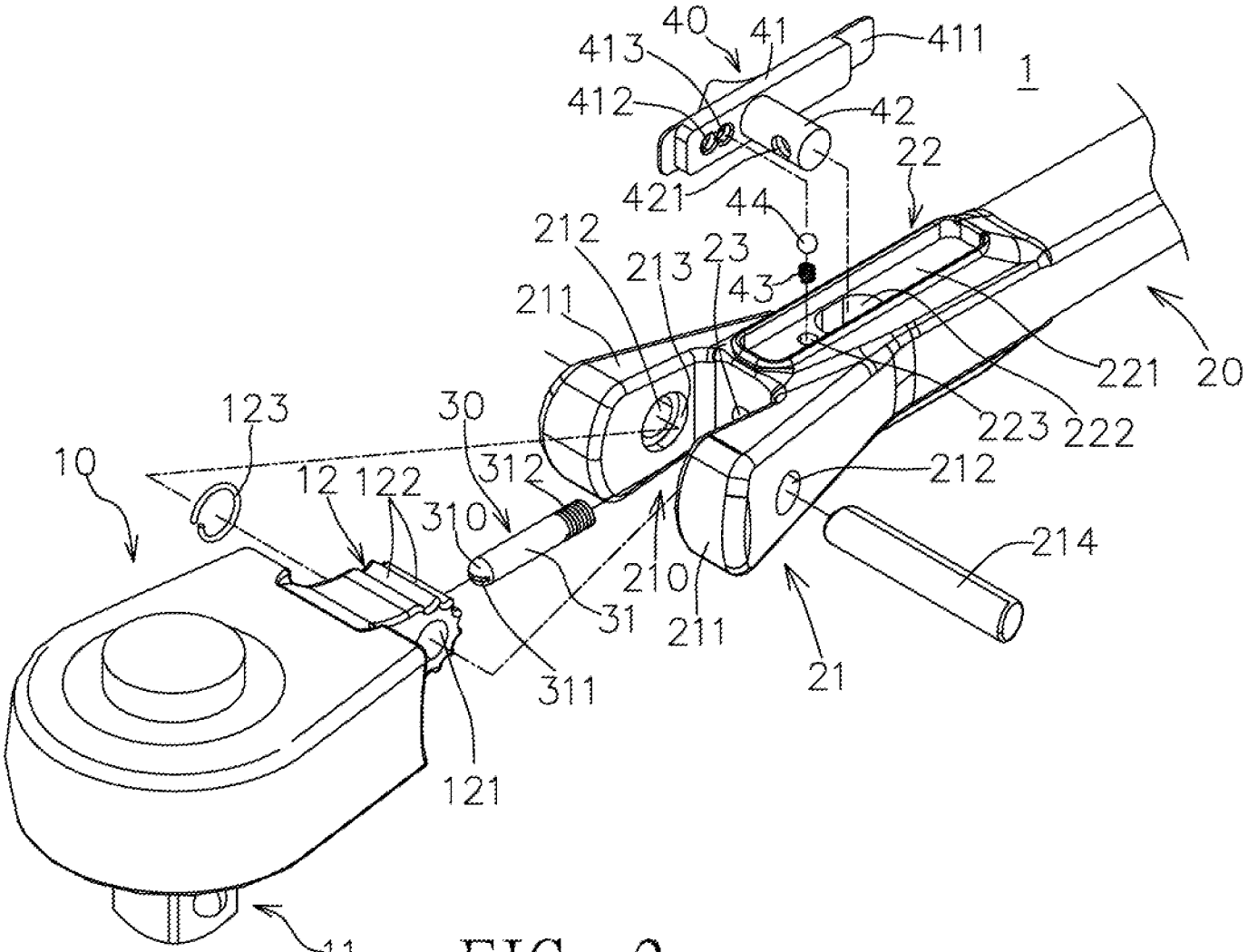
FIG. 2 illustrates a schematic exploded view of the first preferred embodiment of the present invention.
Figure 3:
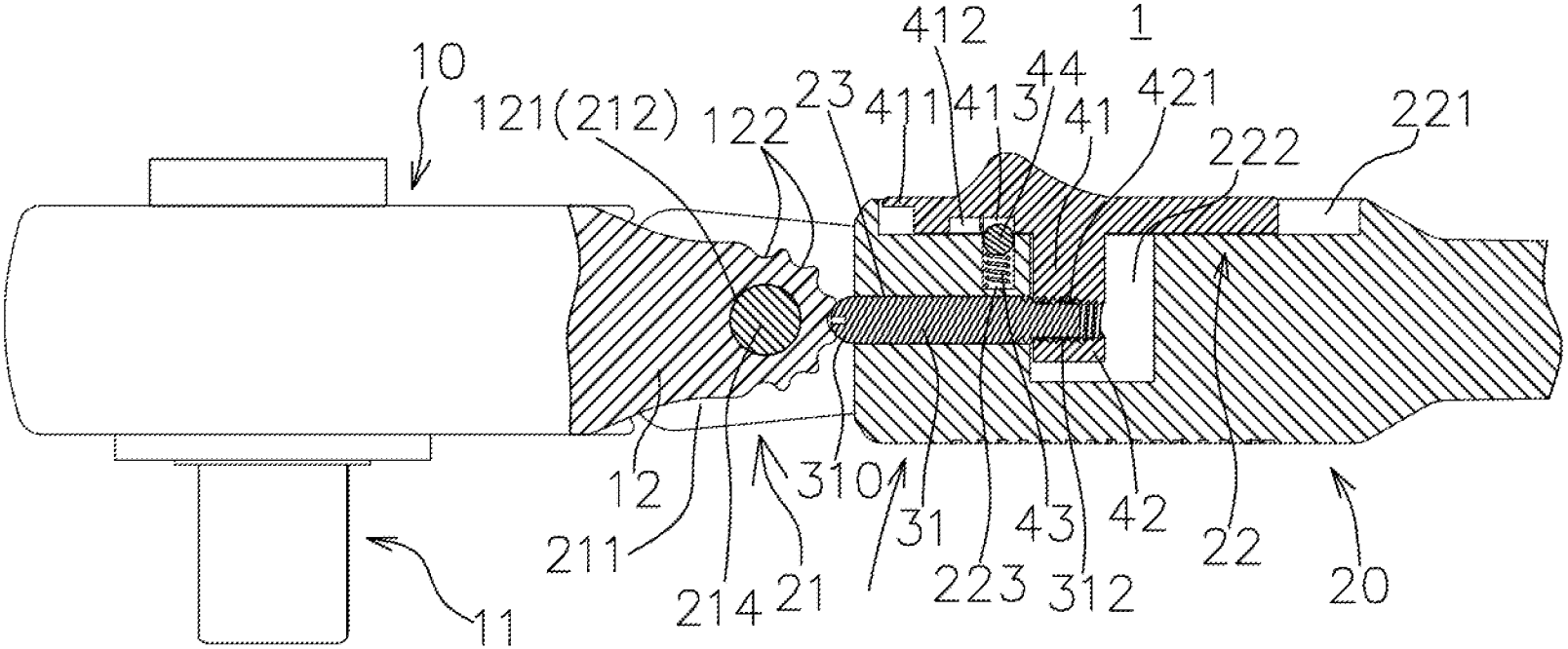
FIG. 3 illustrates a schematic sectional view of the first preferred embodiment of the present invention.

Please refer to FIG. 1, FIG. 2 and FIG. 3, which illustrate a schematic view of a first preferred embodiment of the braking structure of the ratchet wrench of the present invention. As shown in figure, a ratchet wrench 1 includes: a wrench head 10, a wrench handle 20, an urging device 30, and an operation device 40. The wrench head 10 has an operation portion 11, and the operation portion 11 is only an application mode or an accommodation room for female-connecting a working member (not shown in figure), and it is not limited thereto. Hence, the ratchet wrench 1 can be a socket wrench, an open end wrench, a combination wrench, a spanner wrench, an active wrench, etc. According to the direction of the figures, the rear end of the wrench head 10 is an arc head pivoting portion 12 that has a pivoting hole 121, the peripheral of the head pivoting portion 12 has a plurality of urging grooves 122, and the urging grooves 122 is consisted of plural tooth rings.

The front end of the wrench handle 20 has a handle pivoting portion 21, and a positioning device 22 is neighbor to the rear end of the handle pivoting portion 21. The handle pivoting portion 21 has a pair of connecting handles 211 that are separated by a pivoting room 210. The pivoting room 210 is to accommodate the head pivoting portion 12. An acting through hole 23 is at the rear end of the pivoting room 210 and extends toward the wrench handle 20. The connecting handles 211 have a penetrating pivoting hole 212, and the pivoting hole 212 of one of the connecting handles 211 is disposed a ring-enlarged slot 213 where corresponds to the pivoting room 210. The diameter of the ring-enlarged slot 213 is greater than the diameter of the pivoting hole 212. The positioning device 22 has an acting slot 221 with a slim shape. A hole 222 is in the acting slot 221 and is perpendicular to an extension direction of the wrench handle 20, wherein the hole 222 is a long hole and is perpendicular to and connected with the acting through hole 23, or the hole 222 and the acting through hole 23 are perpendicularly connected with each other, wherein an urging hole 223 is in front of the hole 222. For assembly, the head pivoting portion 12 of the wrench head 10 is inserted into the pivoting room 210 of the wrench handle 20. An enforcing ring 213 is thus disposed in the ring-enlarged slot 213. A lockpin 214 goes through the pivoting hole 212 of the handle pivoting portion 21, the pivoting hole 121 of the head pivoting portion 12, and the ring-enlarged slot 213, so as to pivotally connect the wrench head 10 (the head pivoting portion 120) and the wrench handle 20 (handle pivoting portion 21). In the meantime, the urging grooves 122 are in the rear of the pivoting room 210, especially in the pivoting room 210.

The urging device 30 has an urging rod 31. The diameter of the urging rod 31 is less than the diameter of the acting through hole 23. A front end of the urging rod 31 is an urging head 310 that has a rotating slot 311. For the embodiment, the rotating slot 311 is a slot with a special figure as a word figure, for example a straight slot for a straight screwdriver, in order to be driven, and it is not limited thereto. A threaded section 312 is distributed at the rear end of the urging rod 31.

The operation device 40 has a pushing member 41, and a top cover 411 is on the top end of the pushing member 41, and the length of the top cover 411 is longer than the length of the pushing member 41, that is, the top cover 411 elongates itself out of the pushing member 41. The pushing member 41 has an inserting rod 42 underneath, and the diameter of the inserting rod 42 is less than the length of the hole 222, so that the inserting rod 42 can move back and forth in the hole 222. The inserting rod 42 has a positioning through hole 421 that is vertical to the inserting rod 42, and the positioning through hole 421 corresponds to the acting through hole 23, wherein the positioning through hole 421 is a threaded hole. The pushing member 41 has a first urging slot 412 and a second urging slot 413 after the first urging slot 412 beneath. The urging hole 223 has a spring 43 and an urging ball 44, wherein the urging ball 44 is raised or lowered down by the spring 43. The pushing member 41 is disposed in the acting slot 221, and the inserting rod 42 is plugged into the hole 222, and the urging rod 31 is through the acting through hole 23, continuously the threaded section 312 of the urging rod 31 is fixed in the positioning through hole 421 (threaded hole) for tight connection of the urging rod 31 and the positioning through hole 421 and continuous serious operations. According to FIG. 3, to assembly the ratchet wrench 1 is completed.

Figure 4:
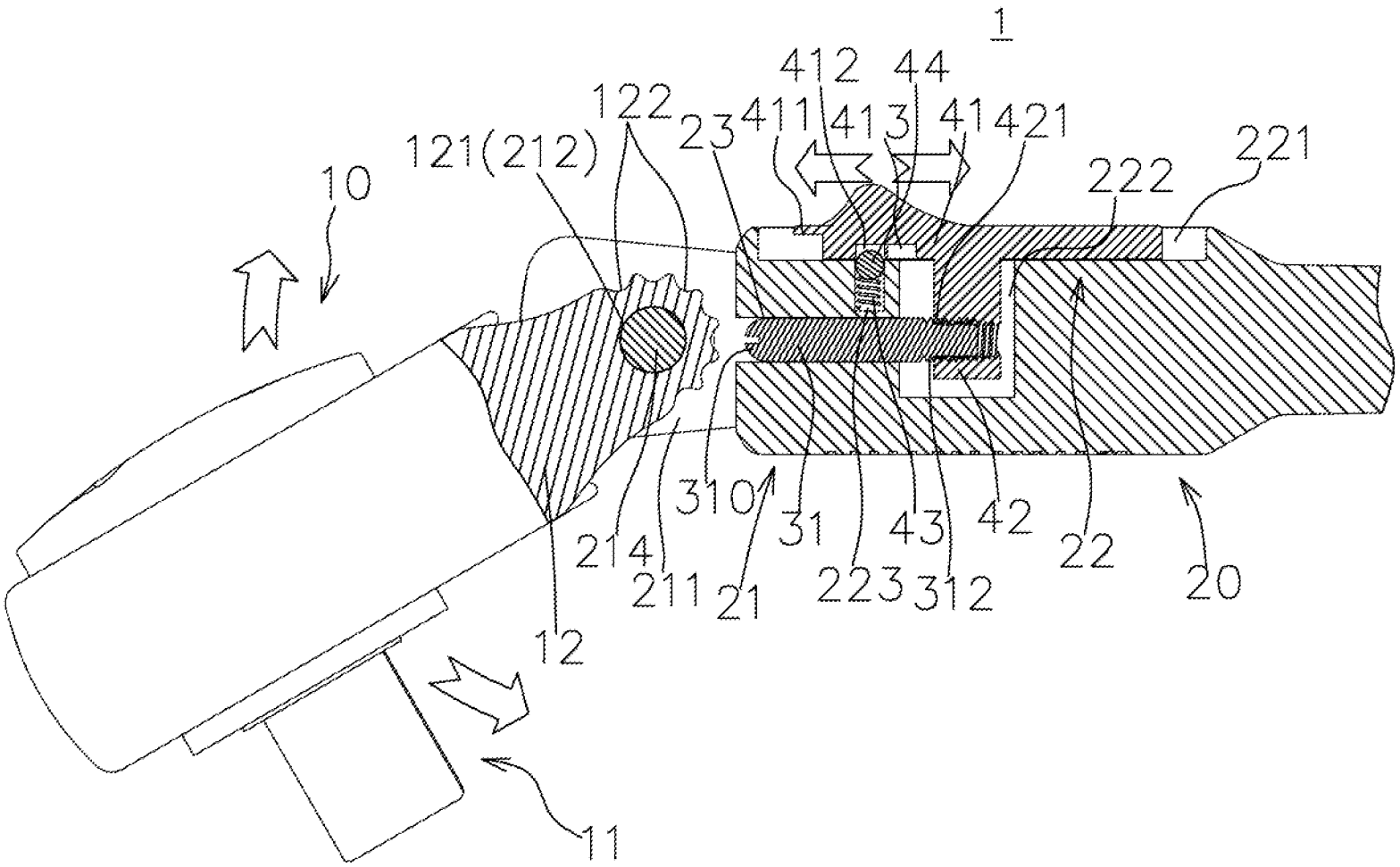
FIG. 4 illustrates a schematic sectional view of adjusting angle of the first preferred embodiment of the present invention.

As shown in FIG. 3, when the pushing member 41 is located ahead, that is, the top cover 411 is pushed forwardly to touch onto the front end of the acting slot 221, or the inserting rod 42 is against to the hole 222, therefore the front end (the urging head 310) of the urging rod 31 protrudes out of the acting through hole 23 in order to urge the urging grooves 122. So that the wrench head 10 is positioned so as to proceed rotation operations by means of fitting pieces (not shown in figure) of the operation portion 11. In the meantime, the urging ball 44 is against to the second urging slot 413 by means of the elastic forces from the spring 43 in order to stop and position the pushing member 41. As shown in FIG. 4, when the wrench head 10 is going to lift and bend, the top cover 411 (the pushing member 41) is moved backward so as to move the inserting rod 42 and the urging rod 31. Hence, the urging rod 31 (the urging head 310 takes off from one of the urging grooves 122, and the urging ball 44 is against to the first urging slot 412 for stopping and positioning the pushing member 41. So that the angle of lifting and bending the wrench head 10 is controlled. On the contrary, the top cover 411 (the pushing member 41) is pushed forwardly to let the urging rod 31 (the urging head 310) be against to one of the urging grooves 122 for completion.

It is to be noted that the combination of the urging rod 31 and the inserting rod 42 is an easy structure and practical, and it is not only that benefit to manufacturing, but also hardly happen disorder, so as to increase life.

Figure 5:
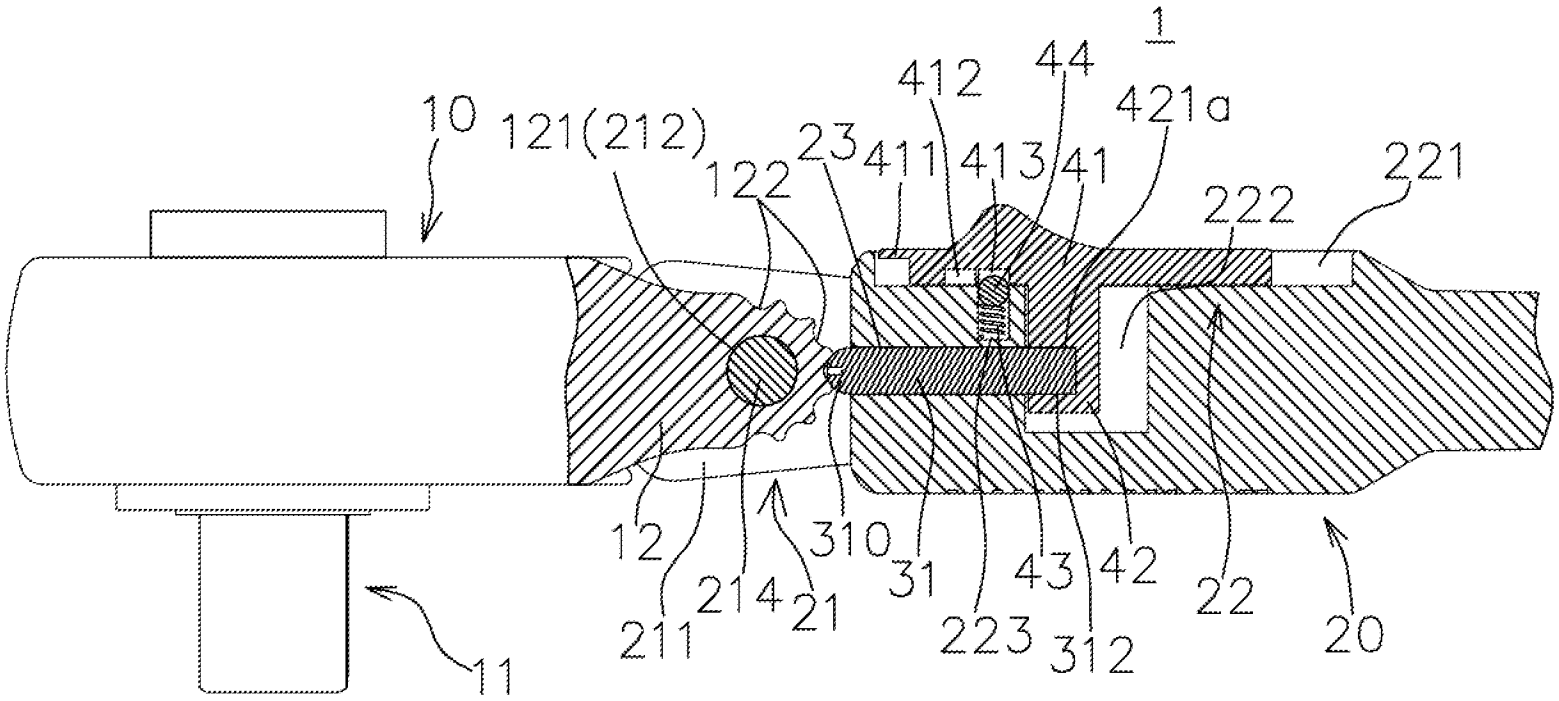
FIG. 5 illustrates a schematic sectional view of a variety of the first preferred embodiment of the present invention.

Please refer to FIG. 5, which illustrates a schematic view of a variable embodiment from the first preferred embodiment of the braking structure of the ratchet wrench of the present invention. The embodiment is another design to the combination of the urging rod 31 and the inserting rod 42, wherein the urging rod 31 is that the rear end thereof is not with the threaded section 312 as the first preferred embodiment, and a positioning through hole 421*a* of the inserting rod 42 is comparatively not with threads. As a conclusion, by way of tight fitting of the urging rod 31 and the positioning through hole 421*a*, the tight connection and following stable continuous operations can be done.

Figure 6:
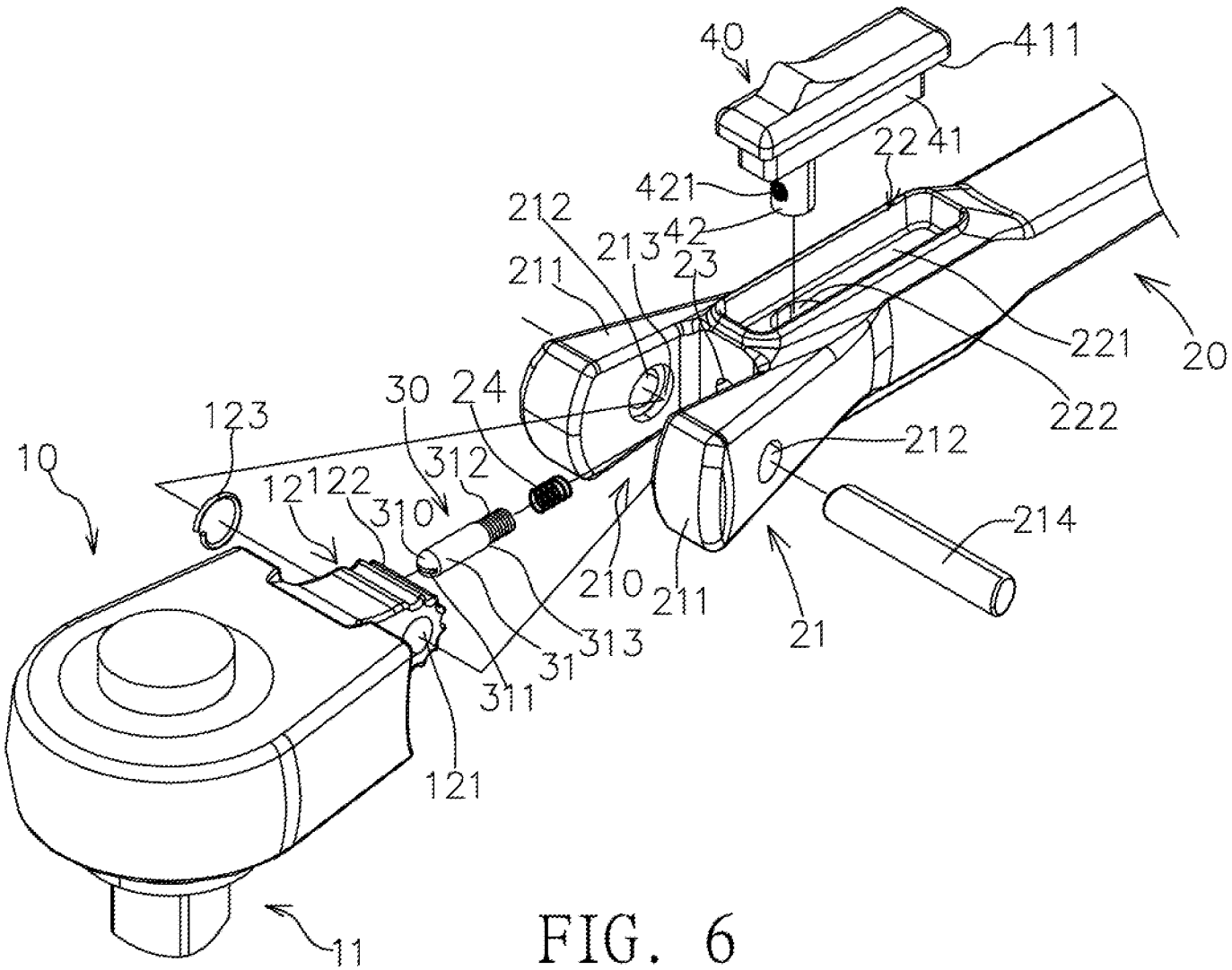
FIG. 6 illustrates a schematic exploded view of a second preferred embodiment of the present invention.
Figure 7:
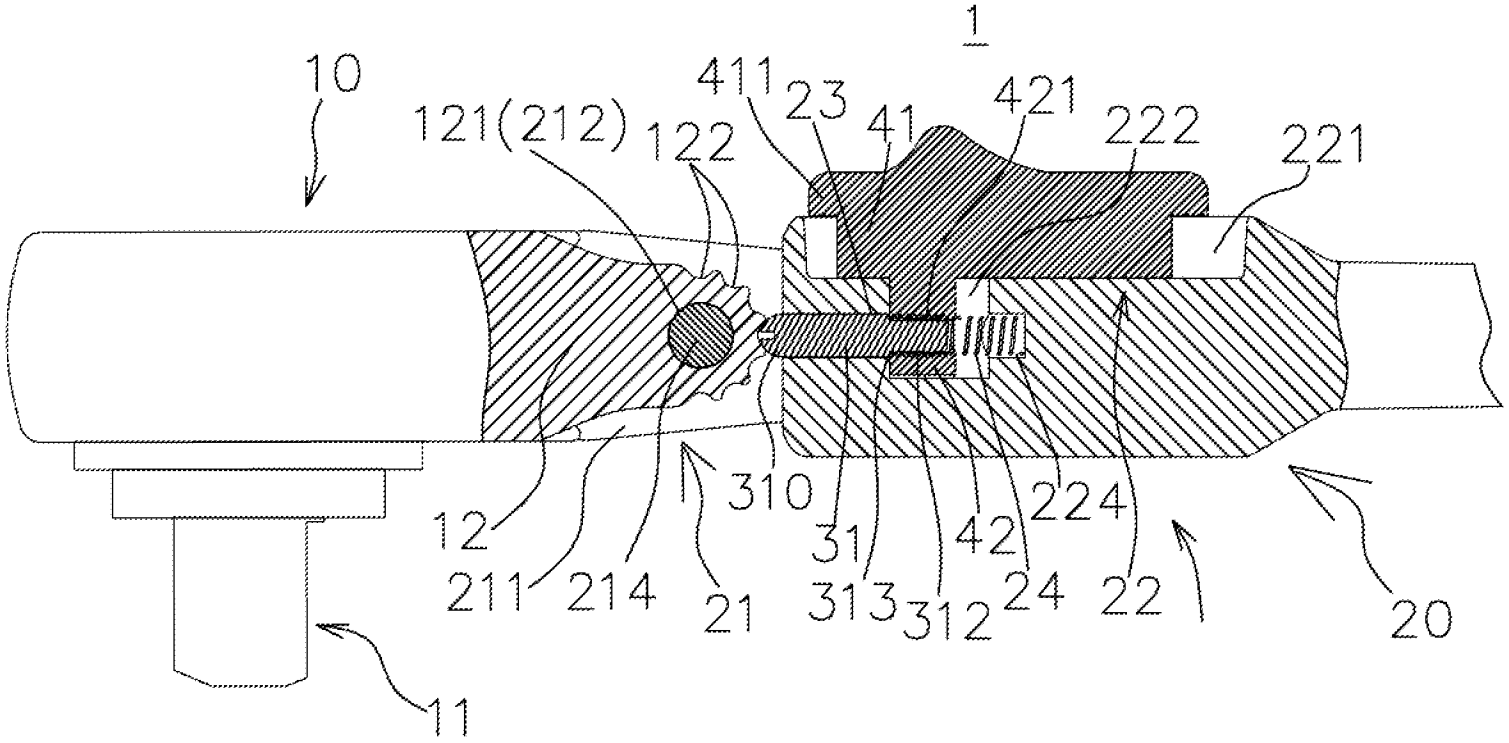
FIG. 7 illustrates a schematic sectional view of the second preferred embodiment of the present invention.
Figure 8:
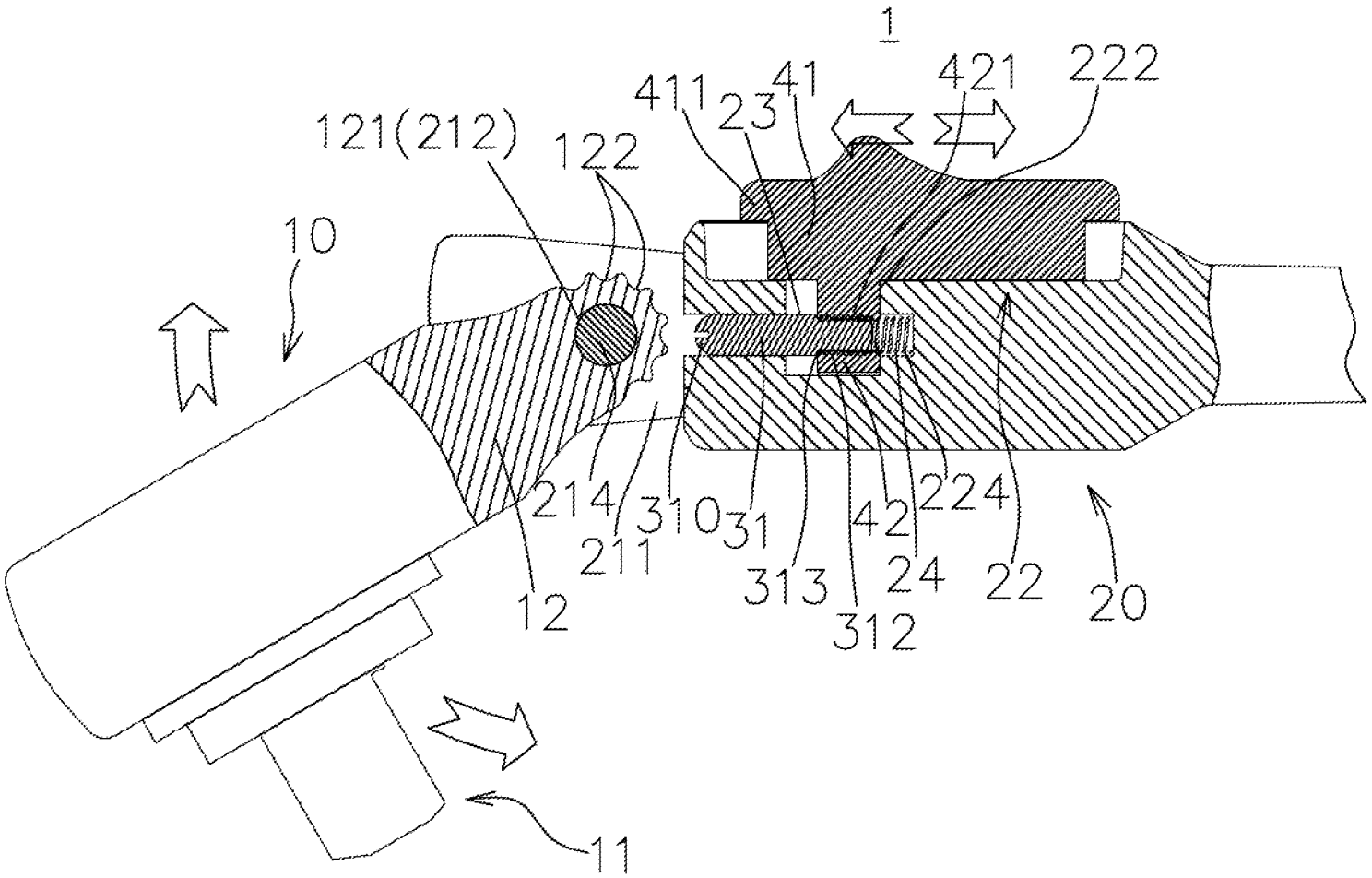
FIG. 8 illustrates a schematic sectional view of operation of the second preferred embodiment of the present invention.

Please refer to FIG. 6, FIG. 7 and FIG. 8, which illustrate a schematic view of a second preferred embodiment of the braking structure of the ratchet wrench of the present invention. The second preferred embodiment is another variable embodiment from the first preferred embodiment, and the differences are described as below. The connection location of the urging rod 31 and the threaded section 312 is disposed an urging ladder 313. The way to form the urging ladder 313 is to make the diameter of the urging rod 31 be greater than the diameter of the threaded section 312. The positioning through hole 421 is a penetrating threaded hole. The positioning device 22 further has a spring slot 224 located at the rear part of the hole 222, and the spring slot 224 is connected with the hole 222 and corresponds the positioning through hole 421, wherein the spring slot 224 has a flexible member 24 inside (ex. spring). Except the inserting rod 42 under the pushing member 41, the present embodiment is not with the first urging slot 412 and the second urging slot 413 as the first preferred embodiment; comparatively, the positioning device 22 may not equipped with the spring 43 and the urging ball 44 for the present embodiment.

The urging rod 31 goes through the acting through hole 23 so as to let the threaded section 312 be screwed with the positioning through hole 421 (threaded hole), further that the urging ladder 313 is the role to stop the threaded section 312. The flexible member 24 urges the rear end of the urging rod 31 in order to move the urging rod 31, the inserting rod 42 and the pushing member 41 forwardly. The front end (the urging head 310) of the urging rod 31 protrudes out of the acting through hole 23 to urge one of the urging grooves 122. So that the wrench head 10 is positioned for rotating operations of fitting pieces of the operation portion 11. When the wrench head 10 is going to lift and bend, the top cover 411 (the pushing member 41) is moved backward and fixed by pressing so as to move the inserting rod 42 and the urging rod 31. Hence, the urging rod 31 (the urging head 310 takes off from one of the urging grooves 122. So that the angle of lifting and bending the wrench head 10 is controlled. On the contrary, the top cover 411 (the pushing member 41) is released from pressing, and the flexible member 24 urges the urging rod 31, the inserting rod 31, the inserting rod 42 and the pushing member 41, in order to let the urging rod 31 (the urging head 310) be against to one of the urging grooves 122 for completing the lift and bend of the wrench head 10.

Figure 9:
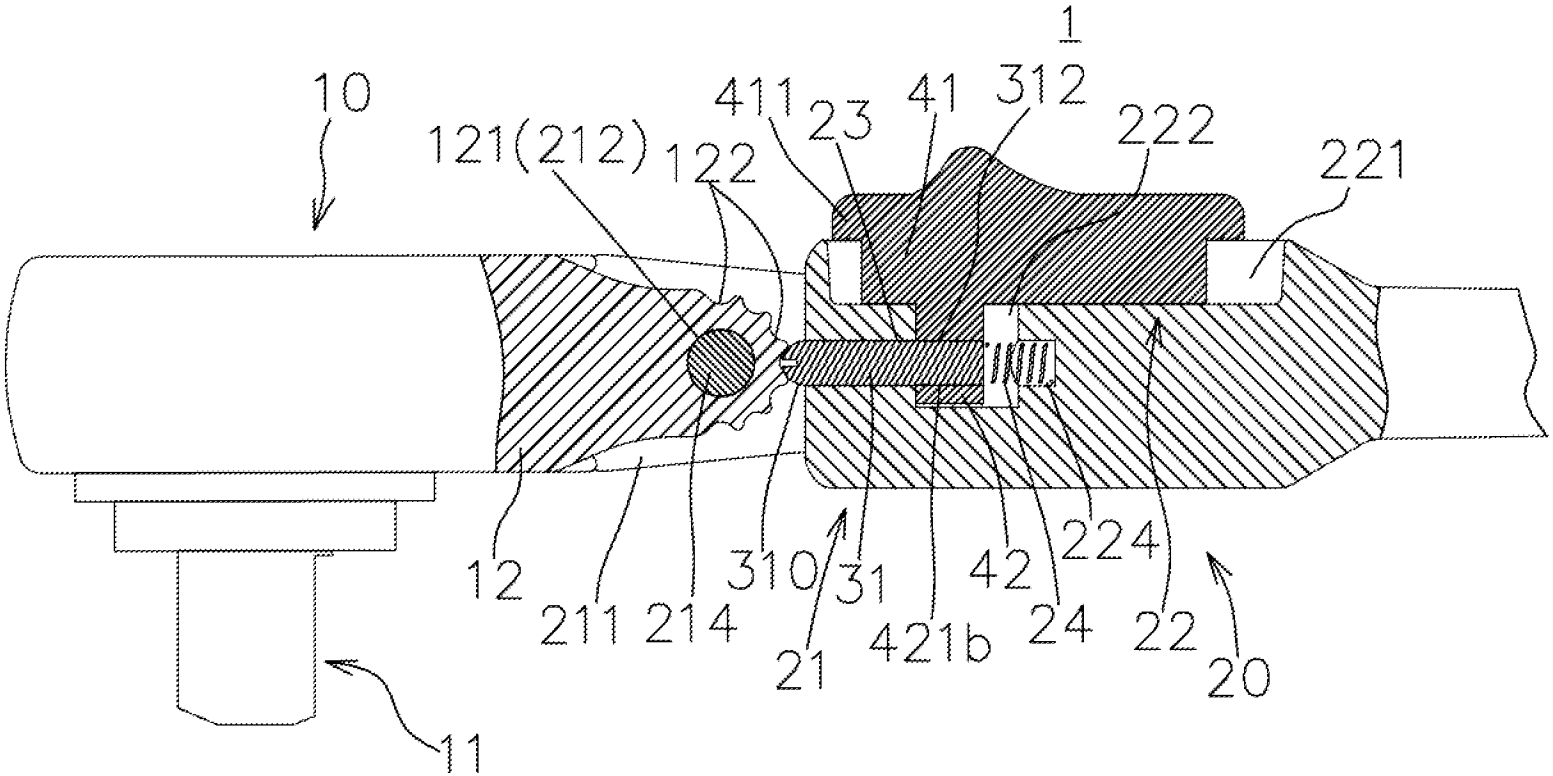
FIG. 9 illustrates a schematic sectional view of a variety of the second preferred embodiment of the present invention.

Please refer to FIG. 9, which illustrates a schematic view of a variable embodiment from the second preferred embodiment of the braking structure of the ratchet wrench of the present invention. The embodiment is another design to the combination of the urging rod 31 and the inserting rod 42, wherein the urging rod 31 is that the rear end thereof is not with the threaded section 312 as the first preferred embodiment, and a positioning through hole 421*b* of the inserting rod 42 is comparatively not with threads and penetrates through the inserting rod 42. As a conclusion, by way of tight fitting of the urging rod 31 and the positioning through hole 421*a*, the tight connection and following stable continuous operations can be done.

The braking structure of the ratchet wrench of the present invention is composed of an easy linking mechanism in order to convenient for manufacturing and assembly, and it is worth for considering economic benefits. On other hand, the present invention prevents loosen parts, shaking and even rupture while in operation, and increases stability and operation certainty for enhancing life and operation quality.

Although the invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. A braking structure of a ratchet wrench comprising:

a wrench head, having an operating portion, a rear end of the wrench head being a head pivoting portion, a peripheral of the head pivoting portion having a plurality of urging grooves;

a wrench handle, a front end of the wrench handle having a handle pivoting portion that is pivotally connected with the head pivoting portion, the handle pivoting portion having a pivoting room, an acting through hole being at a rear end of the pivoting room and extending toward the wrench handle, a positioning device adjacent to a rear end of the handle pivoting portion and having an acting slot extending along an axial direction of the wrench handle and having no connection with the rear end of the pivoting room, an accommodating hole being in the acting slot and being perpendicular to an extension direction of the wrench handle, an urging hole being in the acting slot and located between the rear end of the pivoting room and the accommodating hole, a spring is in the urging hole, an urging ball being on a top of the spring, wherein the accommodating hole has an axial direction perpendicular to and connected with the acting through hole, the accommodating hole has a narrow shape in a plane parallel to a plane of the wrench handle, and a length of the narrow shape extending in the axial direction of the wrench handle is larger than a length of the narrow shape extending in a vertical axial direction of the wrench handle;

an urging device, having an urging rod, wherein a diameter of the urging rod is less than a diameter of the acting through hole and a front end of the urging rod is an urging head that has a rotating slot configured to engagingly receive a flathead screwdriver; and an operation device, having a pushing member that has an inserting rod, the inserting rod having a positioning through hole that is perpendicular to an axial direction of the inserting rod, wherein the diameter of the inserting rod is less than the length of the accommodating hole and the positioning through hole corresponds to the acting through hole, wherein the positioning through hole is a threaded hole, wherein the pushing member is disposed in the acting slot, the inserting rod is inserted into the accommodating hole, and the urging rod is through the acting through hole, continuously a threaded section of the urging rod is fixed in the positioning through hole for tight connection of the urging rod and the positioning through hole, and the urging rod is against to one of the urging grooves;

when the pushing member is located ahead, the inserting rod is against to the accommodating hole, therefore the urging head of the urging rod protrudes out of the acting through hole in order to urge the urging grooves, so that the wrench head is positioned so as to proceed rotation operations by means of fitting pieces of the operation portion;

when the wrench head is going to lift and bend, the pushing member is moved backward so as to move the inserting rod and the urging rod, hence, the urging head of the urging rod takes off from one of the urging grooves, so that the angle of lifting and bending the wrench head is controlled, on the contrary, the pushing member is pushed forwardly to let the urging head of the urging rod be against to one of the urging grooves.

2. The braking structure of the ratchet wrench according to claim 1, wherein a front end of the pushing member has a first urging slot and a second urging slot after the first urging slot.

3. The braking structure of the ratchet wrench according to claim 1, wherein a rear end of the urging rod is an urging ladder, the positioning through hole being blocked by the urging ladder.

4. The braking structure of the ratchet wrench according to claim 1, wherein a top cover is on a top end of the pushing member, and the length of the top cover is longer than the length of the pushing member.

5. The braking structure of the ratchet wrench according to claim 1, wherein the positioning device has a spring slot at a rear end of the accommodating hole, the spring slot being located in the accommodating hole and corresponding to the positioning through hole, a flexible member being disposed in the spring slot and urging to a rear end of the urging rod.

* * * * *